US005595351A

United States Patent [19]

Haasen

[11] Patent Number: 5,595,351

[45] Date of Patent: Jan. 21, 1997

[54] METHOD FOR CONTROLLING A WINDING STATION OF A BOBBIN WINDING MACHINE WHEN A TAKE-UP BOBBIN IS CHANGED AND WINDING STATION FOR PERFORMING THE METHOD

[75] Inventor: Rolf Haasen, Mönchengladbach, Germany

[73] Assignee: W. Schlafhorst AG & Co., Moenchengladbach, Germany

[21] Appl. No.: 338,962

[22] Filed: Nov. 14, 1994

[30] Foreign Application Priority Data

Nov. 18, 1993 [DE] Germany ..... 43 39 217.2

[51] Int. Cl.[6] ..... B65H 54/38; B65H 63/00

[52] U.S. Cl. ..... 242/18 DD; 242/18.1; 242/36

[58] Field of Search ..... 242/18 DD, 36, 242/18.1, 43.2, 18 CS, 18 R, 18 EU

[56] References Cited

U.S. PATENT DOCUMENTS

| | | | |
|---|---|---|---|
| 4,438,889 | 3/1984 | Schonmeier | 242/36 X |
| 4,447,955 | 5/1984 | Stutz et al. | 242/36 X |
| 4,512,526 | 4/1985 | Tone et al. | 242/36 |
| 4,631,682 | 12/1986 | Ng et al. | 242/534.2 X |
| 4,715,550 | 12/1987 | Erni et al. | 242/36 X |
| 4,805,844 | 2/1989 | Hermanns et al. | 242/18 DD |
| 4,828,191 | 5/1989 | Ruge et al. | 242/18 DD X |
| 5,004,171 | 4/1991 | Colli et al. | 242/36 X |
| 5,035,370 | 7/1991 | Hermanns | 242/18.1 |
| 5,074,480 | 12/1991 | Aeppli | 242/36 |
| 5,348,238 | 9/1994 | Yamauchi et al. | 242/18 R |

FOREIGN PATENT DOCUMENTS

| | | | |
|---|---|---|---|
| 0265995 | 5/1988 | European Pat. Off. . | |
| 608025 | 1/1935 | Germany . | |
| 2406793 | 6/1975 | Germany . | |
| 3213631 | 10/1982 | Germany . | |
| 3611263 | 10/1986 | Germany . | |
| 3703869 | 8/1988 | Germany . | |
| 3838573 | 7/1989 | Germany . | |
| 3914865 | 11/1989 | Germany . | |
| 3916918 | 11/1990 | Germany . | |
| 3920374 | 1/1991 | Germany | 242/18 DD |

OTHER PUBLICATIONS

Japanese Patent Abstract No. 56–52365, Takeda, dated Nov. 5, 1981.

Japanese Patent Abstract No. 56–52364, Takeda, dated Nov. 5, 1981.

*Primary Examiner*—Michael R. Mansen

*Attorney, Agent, or Firm*—Herbert L. Lerner; Laurence A. Greenberg

[57] ABSTRACT

A method and apparatus for controlling a winding station of a bobbin winding machine when changing a take-up bobbin includes driving the take-up bobbin by contact with a yarn guide drum depositing a yarn, and bringing the take-up bobbin to a standstill by controlled deceleration of a rotary speed of the yarn guide drum after ascertaining that a predetermined yarn quantity has been reached, until the yarn guide drum comes to a standstill. This is done while producing a varying slip between a surface of the yarn guide drum and a surface of the take-up bobbin effecting ribbon prevention but being limited to avoid knocking the yarn off the bobbin and damage to the surface of the bobbin. A winding station of a bobbin winding machine includes a yarn guide drum driving a take-up bobbin by contact while depositing a traveling yarn on the take-up bobbin. A drive mechanism for the yarn guide drum has a rotary field motor. An electronic yarn cleaner monitors the traveling yarn. A measuring device detects attainment of a predetermined yarn quantity and outputs a signal. A circuit is activated by the signal for reducing a rotary field frequency of the rotary field motor down to 0 Hertz in increments.

10 Claims, 2 Drawing Sheets

METHOD FOR CONTROLLING A WINDING STATION OF A BOBBIN WINDING MACHINE WHEN A TAKE-UP BOBBIN IS CHANGED AND WINDING STATION FOR PERFORMING THE METHOD

BACKGROUND OF THE INVENTION

Field of the Invention

The invention relates to a method for controlling a winding station of a bobbin winding machine when a take-up bobbin is changed, which includes driving the take-up bobbin by contact with a yarn guide drum depositing a yarn, and bringing the take-up bobbin to a standstill when a predetermined quantity of yarn is reached. The invention also relates to a winding station for carrying out the method.

In present-day bobbin winding machines, changing the take-up bobbins, which as a rule are cylindrical or conical cross-wound bobbins and are also known as cheeses, is performed automatically by a changer unit. In order to perform the changing process, the take-up bobbin must first come to a standstill. Moreover, yarn travel must not be interrupted during the change. If the standstill once a desired or predeterminable quantity of yarn has been wound up is to be achieved, then the actual yarn quantity must be checked constantly, so that the attainment of the specified yarn quantity can be detected.

In German Patent No. 608 025, the present diameter of the take-up bobbin is determined through deflection of a creel. When a specified yarn quantity, in that case the specified diameter, is reached, a drive drum is braked sharply through mechanical switch elements and a friction coupling. That can not only damage the surface of the bobbin but can also cause yarn to be knocked off the bobbin.

In order to prevent such an occurrence, it has been proposed in German Published, Non-Prosecuted Application DE 32 13 631 A1 that only the drive mechanism be shut off, and that the yarn guide drum with the take-up bobbin resting on it be allowed to come to a stop. That process of slowing to a stop takes a relatively long time because of the inertia of the rotating packages. Moreover, in that phase of slowing to a stop, the synchronized travel of the yarn guide drum and the take-up bobbin in terms of their circumferential speed can cause ribboning, which causes considerable problems in subsequent processing of the take-up bobbin. Moreover, the relatively long rundown time, which is dictated by inertia, causes differences in the length of yarn being wound up. That in turn leads to yarn remnants when the take-up bobbins are later paid out jointly from the same creel.

In order to avoid those disadvantages, German Published, Non-Prosecuted Application DE 36 11 263 A1, which defines a generic method and apparatus from which the invention begins, proposes cutting the traveling yarn when the specified yarn length is reached, lifting the take-up bobbin from the yarn guide drum, braking the two rotating packages separately, and then joining the yarn ends again and briefly starting up the winding station again. In that way, the wound-up quantity of yarn is adjusted very precisely, and ribboning is also avoided. However, a disadvantage thereof is that when the take-up bobbin is later unwound, for instance from a creel on which it is mounted, all of the yarn joining stations are unwound at the same time. That can cause a visible flaw in a fabric made from it.

SUMMARY OF THE INVENTION

It is accordingly an object of the invention to provide a method for controlling a winding station of a bobbin winding machine when a take-up bobbin is changed and a winding station for performing the method, which overcome the hereinafore-mentioned disadvantages of the heretofore-known methods and devices of this general type and in which the quantity of yarn wound up onto the take-up bobbins can be adhered to precisely, without producing a visible defect in the quality of the final product.

With the foregoing and other objects in view there is provided, in accordance with the invention, a method for controlling a winding station of a bobbin winding machine when changing a take-up bobbin, which comprises driving the take-up bobbin by contact with a yarn guide drum depositing a yarn; and bringing the take-up bobbin to a standstill by controlled deceleration of a rotary speed of the yarn guide drum after ascertaining that a predetermined yarn quantity has been reached, until the yarn guide drum comes to a standstill, while producing a varying slip between a surface of the yarn guide drum and a surface of the take-up bobbin effecting ribbon prevention but being limited to avoid knocking the yarn off the bobbin and damage to the surface of the bobbin.

With the objects of the invention in view, there is also provided a winding station of a bobbin winding machine for performing the method, comprising a yarn guide drum driving a take-up bobbin by contact while depositing a traveling yarn on the take-up bobbin; a drive mechanism for the yarn guide drum having a rotary field motor; an electronic yarn cleaner for monitoring the traveling yarn; a measuring device for detecting attainment of a predetermined yarn quantity and outputting a signal; and a circuit being activated by the signal for reducing a rotary field frequency of the rotary field motor down to 0 Hertz in increments.

Deceleration of the rotational speed of the yarn guide drum in such a way as to produce a varying slip considerably shortens the time until the bobbin and yarn guide drum are at a standstill, as compared with the known unbraked rundown mode. Limiting the slip to an amount in which yarn is not knocked off the bobbin, nor is any other damage to the bobbin surface caused, nevertheless allows a short braking time that is comparable to the time taken by a yarn joining operation. However, as compared with the version described in the publication defining the generic method and apparatus from which the invention begins, the time for restarting bobbin winding, including checking the yarn joint and re-braking, is not needed. There is no compulsory yarn joining point which leads to quality defects in the final product, as is the case in the generic version. Moreover, as compared with the version with a rundown dictated by inertia, ribbon windings (rundown patterns) are effectively avoided.

In a typical use of a rotary field motor for driving the yarn guide drum, the varying slip can easily be adjusted within the tolerance limits, by incremental reduction of the frequency of rotation.

In accordance with another mode of the invention, there is provided a method which comprises monitoring travel of the yarn as a function of speed during an entire deceleration phase.

In accordance with a further mode of the invention, there is provided a method which comprises decelerating the yarn guide drum in increments.

In accordance with an added mode of the invention, there is provided a method which comprises empirically ascertaining dimensions of the deceleration increments in advance, as a function of winding parameters.

In accordance with an additional mode of the invention, there is provided a method which comprises constantly monitoring the slip during the deceleration phase, and regulating a graduation within predeterminable slip tolerance limits.

In accordance with yet another mode of the invention, there is provided a method which comprises establishing a predeterminable yarn length being less than a desired yarn length by an amount being equivalent to a yarn length being still wound on during the deceleration.

In accordance with another feature of the invention, there is provided an evaluation device associated with the electronic yarn cleaner, the evaluation device being connected to the circuit for triggering the circuit as a function of a dropping yarn speed.

In accordance with a further feature of the invention, there is provided a memory receiving a graduation for the incremental reduction of the rotary field frequency.

In accordance with a concomitant feature of the invention, the measuring device monitors rotary speeds of the yarn guide drum and the take-up bobbin; and there is provided a comparator circuit comparing a difference in circumferential speed ascertained from the rotary speeds on the basis of diameters and having an output being connected to the circuit for graduating the rotary field frequency.

Monitoring the traveling yarn in the deceleration phase as well means that while the take-up bobbin is coming to a standstill, no undetected yarn flaws, such as slubs, can run up onto the bobbin. In presently typical electronic yarn cleaners, which are adjusted to an operating yarn travel speed, an evaluatable measurement is no longer possible, particularly in the second half of the deceleration phase. By comparison, because of the speed-dependent monitoring, the possibility of yarn monitoring extends to the deceleration phase of the take-up bobbin as well. Transmitting the circumferential speed of the take-up bobbin, or also of the yarn guide drum having a circumferential speed which differs only slightly from it as a result of slip, to the yarn cleaner evaluation unit, makes this speed-dependent monitoring possible.

Decelerating the yarn guide drum in increments can be controlled without difficulty, for instance through a frequency converter. Since the take-up bobbin cannot follow this graduation because of inertia, the aforementioned varying slip arises. The intervals between graduations, in particular, can be adjusted as a function of the winding parameters. However, it is also conceivable to vary the magnitude of the graduation, optionally in combination with the length of the intervals. An empirically ascertained graduation for keeping within the tolerance range for the slip can be stored in a memory, for instance. However, it is also possible to ascertain the slip continuously, based on the difference in the circumferential speeds of the take-up bobbin and the yarn guide drum, and to regulate it during the deceleration phase by suitable graduation.

Other features which are considered as characteristic for the invention are set forth in the appended claims.

Although the invention is illustrated and described herein as embodied in a method for controlling a winding station of a bobbin winding machine when a take-up bobbin is changed and a winding station for performing the method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
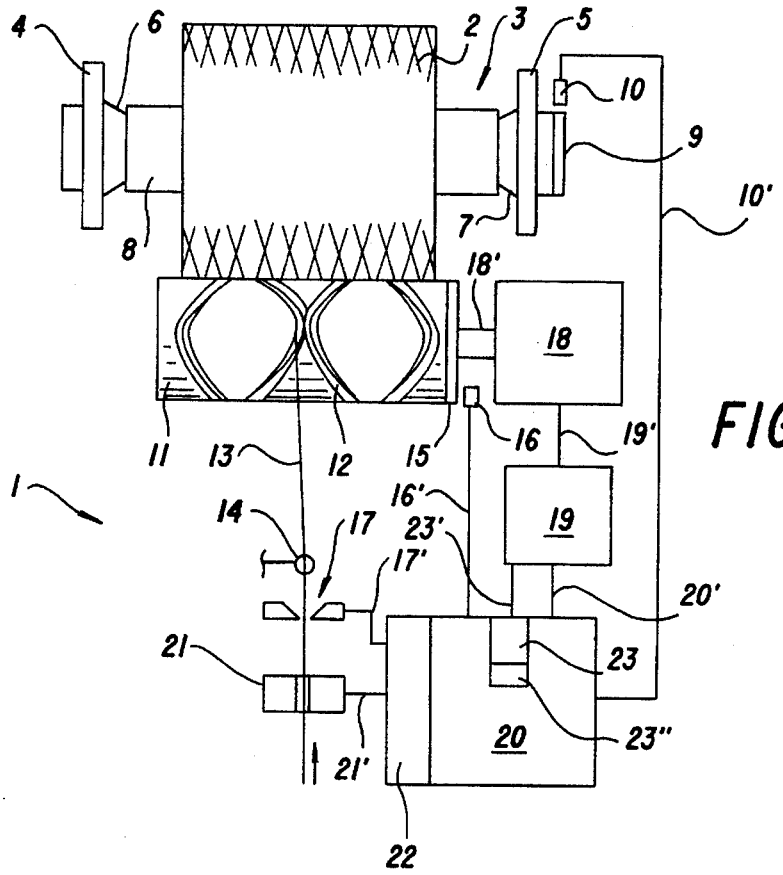
FIG. 1 is a simplified, diagrammatic, front-elevation view and a block circuit diagram of a winding-up part of a winding station of a bobbin winding machine.

Referring now to the figures of the drawing in detail and first, particularly, to FIG. 1 thereof, there is seen only an upper part of a winding station 1 containing only those parts that are essential to the invention. For instance, no attempt was made to show a yarn joining device or other components that are usually present at a winding station, because they are unnecessary for the explanation of the invention.

A take-up bobbin, which is a cylindrical cross-wound bobbin or cheese 2, has a bobbin tube 8 that is fastened between tube plates 6 and 7 that are supported rotatably in bobbin holders 4 and 5 of a creel 3. The tube plate 7 is firmly joined to a pole wheel 9, which is monitored by a Hall sensor 10. The Hall sensor 10 is connected over a line 10' to a winding station computer 20. The winding station computer 20 has a non-illustrated incremental counter at an input for the line 10', through which the rotary angle of the cheese 2 can be monitored.

The cheese 2 is driven at its periphery by means of a yarn guide drum 11. This yarn guide drum has a yarn guide groove 12 with a reversing-winding form machined into it. Through the use of this yarn guide groove 12, a yarn 13 is deposited on the cheese 2 in a random winding.

The yarn guide drum 11 is driven by a rotary current motor 18 through a drive shaft 18'. The rotary current motor 18 is triggered over a control line 19' by a frequency converter 19, which predetermines the rpm of the yarn guide drum 11 through the rotary field frequency. The frequency converter 19 in turn is triggered by the winding station computer 20 over a control line 20'.

A pole wheel 15, which is monitored by a Hall sensor 16, is mounted on the yarn guide drum 11. The Hall sensor 16 in turn is connected to the winding station computer 20 over an information line 16'. During normal operation, the winding station computer 20 acts through the frequency converter 19 to trigger the motor 18 to avoid ribbon windings (patterns), in such a way that within a predeterminable rpm tolerance range, the rpm is raised relatively quickly from a lower tolerance limit to an upper tolerance limit, after which the motor remains off until such time as the lower limit value is again reached as a result of the dropping of the rpm. While the cheese 2 remains behind, creating slip because of its inertia, during runup of the drive mechanism each shutoff of the drive mechanism is followed by a slip-free phase. In this slip-free phase, the angular speeds of the yarn guide drum 11 and the cheese 2, which are ascertained by the Hall sensors 10 and 16, are compared in the winding station computer 20 in order to calculate the current diameter of the cheese 2. This thus-determined diameter can be used, for instance, to determine the diameter-dependent time when the cheese needs to be changed. In practice, it is also known to-determine both the diameter and the wound-on yarn quantity. As a result, by way of determining the yarn length, it is possible to carry out the change of the cheese whenever the command or set-point yarn length has precisely been reached.

At the same time, however, a corresponding maximum diameter is specified, which must not be exceeded. This maximum diameter can even be reached in a malfunction situation before the intended or command or set-point length has been wound on. This happens, for instance, if the bobbin was wound too softly. Moreover, the value of the cheese diameter is also of interest for other control processes, such as the reverse speed in searching for the yarn.

The actually wound-on yarn length is determined by counting the increments transmitted by the Hall sensor 16 in the incremental counter which is integrated with the winding station computer 20. In this process, the rpm of the yarn guide roller 11 is multiplied by the known periphery of the yarn guide drum. In order to eliminate the slip variable in this case, the finding of the incremental counter can be cleaned of the slip variable by way of correction factors.

The yarn 13 travels through a yarn guide slit of an electronic yarn cleaner 21, which optically/capacitively measures the yarn dimensions or the yarn mass. This electronic yarn cleaner 21 is connected over an information line 21' to an evaluation unit 22. This evaluation unit 22 compares slubs and thin points ascertained by the yarn cleaner 21 with predetermined tolerance values, in terms of the defect length in combination with the known yarn travel speed. If intolerable deviations are found, then a cutting device 17 is actuated over a control line 17' to cut apart the yarn 13 and clamp it if applicable. Following that, a yarn joining process is carried out, once the defective piece of yarn has been cut out. A yarn guide 14 disposed downstream of the cutting device 17 serves to form a cross-winding triangle when the yarn 13 is deposited by means of the yarn guide groove 12.

If the winding station computer, in the manner described above, has ascertained that the predetermined yarn length is reached, then a circuit 23 which is integrated with the winding station computer 20 is activated. This circuit 23 is connected to the frequency converter 19 over a control line 23'. Simultaneously with the activation of the circuit 23, the connection between the winding station computer 20 and the frequency converter 19 over the control line 20' is broken. This means that the above-described ribboning prevention, which is active in normal operation, also becomes inoperative.

The graduation of the rotary field frequency of the frequency converter 19, or following the motor 18, is determined by a predetermined tolerance range for slip between the yarn guide drum 11 and the cheese 12. The diameter of the yarn guide drum 11 and the cheese 12, which is most recently ascertained on the basis of the angular speed comparison between them, is made the foundation for determining the slip, in a comparator circuit 23".

Advantageously, the intervals between indexing increments can be adjusted in such a way that the next indexing increment is started whenever the slip is precisely zero again. However, it is also conceivable to instead vary the magnitude of the frequency increments. It is also possible to vary both the frequency increments and the intervals, in such a way that the constantly varying slip remains within the specified tolerance limits. While one tolerance limit is advantageously at zero slip, the other tolerance limit should be such that solely slip-dictated knocking off of yarn from the bobbin or other damage to the cheese surface is avoided. It must be noted that a relatively great slip not only shortens the braking time but also promotes ribbon prevention. In order to attain this goal, the lower tolerance limit for the slip can also be above zero. The tolerance limits are defined as a function of winding parameters.

In the determination of the yarn length at which the circuit 23 is activated, it is advantageous to choose a value that is below the command or set-point value by an amount equivalent to the quantity of yarn that is still wound up during the deceleration phase. The command or set-point value can thus be attained exactly. However, as compared with the known inertia-dictated rundown of the rotating packages, given the strong deceleration of rotation according to the invention, it is possible to hold precisely to the still-wound-up yarn quantity. Since this takes place in all of the winding stations, no significant differences in the quantities of yarn wound up onto the finished cheeses result. In this way, the main goal of cutting to length in this way can be achieved, which is that all of the bobbins mounted on one creel run out simultaneously. This avoids waste in this area.

The evaluation unit or device 22 for the electronic yarn cleaner 21 is informed by the winding station computer 20 about the yarn speed that is ascertained as described above and varies constantly in the deceleration phase. As a result, an exact evaluation of the signals furnished by the yarn cleaner 21 can be accomplished. It is accordingly possible to detect yarn flaws even if they pass through the measurement slit of the electronic cleaner 21 shortly before the cheese 2 comes to a standstill. Even in that case, the yarn cutting device 17 is actuated over the control line 17'. As a result, in turn, a normal yarn joining cycle is started. At the end of this yarn joining cycle, a check is merely made, by a brief startup of the winding station, as to whether or not the yarn joint has been made. Optionally, if there is a yarn break at the beginning of the deceleration time, the winding time can be lengthened by a predeterminable amount, with a reduced winding speed after the yarn break has been corrected. Since this involves a single yarn joining station, it is not expressed as a flaw in the finished fabric that is produced subsequently.

Figure 2:
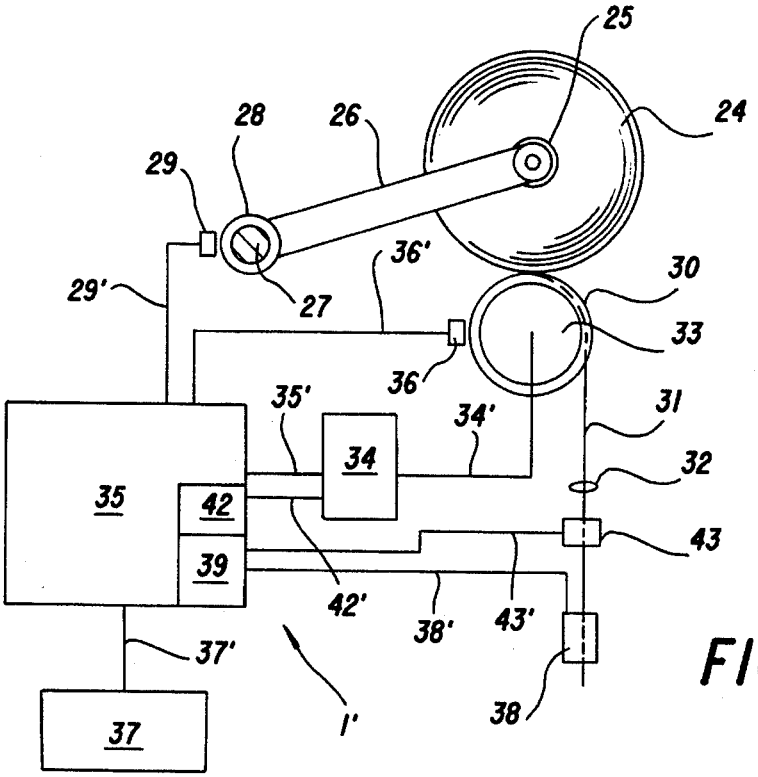
FIG. 2 is a side-elevational view of a variant of the device of FIG. 1.

In a variant of the invention shown in FIG. 2, the diameter of a cheese 24, which is retained between tube plates 25, is determined at a winding station 1' by the angular position of a creel, of which only a creel arm 26 can be seen. A pole wheel 28, which is monitored by a Hall sensor 29, is disposed in the vicinity of a pivot shaft 27 of the creel. The Hall sensor 29 is connected to a winding station computer 35 over an information line 29'. The angular speed of a yarn guide drum 30 is taken from a Hall sensor 36, at a non-illustrated pole wheel, similarly to the first example. The Hall sensor 36 is likewise connected to the winding station computer 35, over an information line 36'. A yarn 31 is also wound up onto the cheese 24 in a random winding, by means of non-illustrated yarn guide grooves of the yarn guide drum 30. A yarn guide 32 defines the cross-winding triangle. Upstream, there is an electronic yarn cleaner 38, which is connected to an evaluation unit 39 of the winding station computer 35 over an information line 38'.

The deceleration increments, which are ascertained empirically beforehand as a function of the winding parameters, are stored in terms of their dimensions in a memory 37, for the sake of the incremental reduction of the rotary field frequency in a frequency converter 34 or in a motor 33.

This memory 37 is connected to the winding station computer 35 over a connecting line 37', but it may also be integrated directly with the computer.

The winding station computer 35 controls the frequency converter 34 over a control line 35', while the frequency converter 34 acts over a control line 34' to determine the rotary field frequency and therefore the rpm of the motor 33. Some other ribbon prevention means can also be employed in normal operation, in which case, within certain tolerance limits, an alternating slip is, for instance, produced by actively accelerating and decelerating the drive of the motor 33. This is possible, since the diameter of the cheese 24 is determined not by the ratio of the angular speeds of the rotating packages but rather by the angular position of the creel.

A circuit 42, which is connected to the frequency converter 34 over a control line 42', can be activated and then operated analogously to the first example. The only difference is that in this case, as described above, the graduation of the rotary field frequency is controlled on the basis of the values stored in the memory 37.

Once again, the evaluation is performed in speed-dependent fashion in the deceleration phase in the evaluation unit 39 for the electronic yarn cleaner 38. A control line 43' connects the evaluation unit with a cutting device 43, which is operated analogously to the cutting device 17 of the first example.

Figure 3:
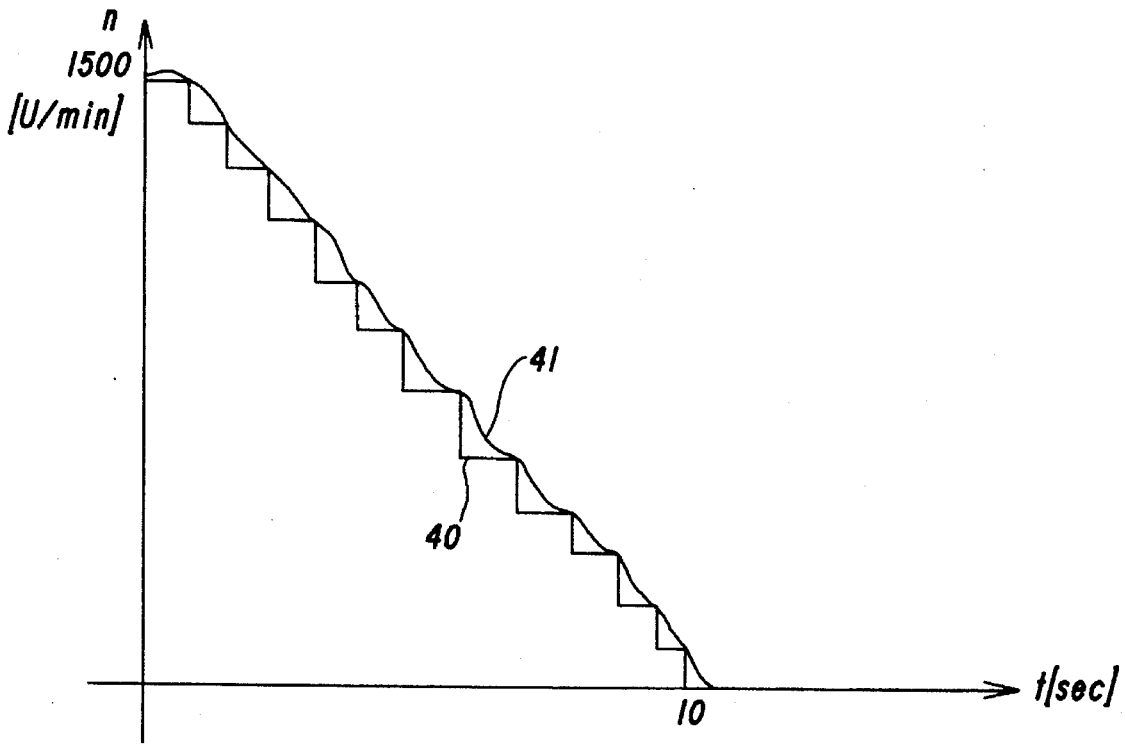
FIG. 3 is a graphic illustration of a course of deceleration of a yarn guide drum and a take-up bobbin.

FIG. 3 shows a deceleration function 40 of the yarn guide drum, from which the above-described graduation can be seen. A deceleration function 41 of the take-up bobbin or cheese exhibits a virtually linear course. After each graduation increment, or in other words at the beginning of an interval between graduations, the slip between the yarn guide drum and the cheese is at a maximum in each case, and in this case it returns to zero by the end of the graduation interval. However, as described above, in each case it would also be possible to terminate the interval between graduations before the slip becomes zero. That would produce a steeper curve, or in other words it would shorten the deceleration time. In that case, however, care must be taken to ensure that the slip is not so great as to lead to knocking over of yarn or damage to the bobbin surface.

I claim:

1. In a method for controlling a winding station of a bobbin winding machine when changing a take-up bobbin, the improvement which comprises: driving the take-up bobbin by contact with a driven yarn guide drum and simultaneously depositing a yarn on the take-up bobbin with the yarn guide drum;

ascertaining that a predetermined yarn quantity has been wound onto the take-up bobbin, subsequently decelerating the take-up bobbin to a standstill by controlled deceleration of a rotary speed of the yarn guide drum and, by means of the controlled deceleration, causing a varying slip between a surface of the yarn guide drum and a surface of the take-up bobbin, the varying slip being great enough to prevent ribbon formation, yet being limited so as to avoid knocking the yarn off the bobbin and damaging the surface of the bobbin.

2. The method according to claim 1, which comprises, during the decelerating step, monitoring travel of the yarn as a function of a yarn speed during an entire deceleration phase in the decelerating step.

3. The method according to claim 2, which comprises decelerating the yarn guide drum in increments.

4. The method according to claim 3, which comprises empirically ascertaining dimensions of the deceleration increments in advance, as a function of winding parameters.

5. The method according to claim 3, which comprises constantly monitoring the slip during the deceleration phase, and regulating a graduation within predeterminable slip tolerance limits.

6. The method according to claim 1, which comprises, prior to the ascertaining step, establishing the predetermined yarn quantity being less than a desired yarn length by an amount equivalent to a yarn length still being wound on during the deceleration.

7. A winding station of a bobbin winding machine for driving a take-up bobbin and bringing the take-up bobbin to a standstill when a predeterminable yarn quantity is reached for changing the take-up bobbin, comprising:

a yarn guide drum driving a take-up bobbin by contact while depositing a traveling yarn on the take-up bobbin; a drive mechanism for the yarn guide drum having a rotary field motor;

an electronic yarn cleaner for monitoring the traveling yarn;

a measuring device for detecting attainment of a predetermined yarn quantity and outputting a signal; and means for decelerating the take-up bobbin to a standstill by controlled deceleration of a rotary speed of the yarn guide drum and, by means of the controlled deceleration, causing a varying slip between a surface of the yarn guide drum and a surface of the take-up bobbin, the varying slip being great enough to prevent ribbon formation, yet being limited so as to avoid knocking the yarn off the bobbin and damaging the surface of the bobbin, said means including a circuit being activated by the signal for reducing a rotary field frequency of said rotary field motor down to 0 Hertz in increments.

8. The winding station according to claim 7, including an evaluation device connected to said electronic yarn cleaner, said evaluation device being connected to said circuit for controlling said circuit as a function of a decreasing yarn speed in a deceleration phase.

9. The winding station according to claim 7, including a memory connected to said circuit, said memory receiving a graduation for the incremental reduction of the rotary field frequency.

10. The winding station according to claim 7, wherein said measuring device monitors rotary speeds of said yarn guide drum and the take-up bobbin; and including a comparator circuit comparing a difference in circumferential speed ascertained from the rotary speeds on the basis of diameters and having an output being connected to said circuit.

* * * * *